US006591500B1

(12) United States Patent
Suzuki et al.

(10) Patent No.: US 6,591,500 B1
(45) Date of Patent: Jul. 15, 2003

(54) METHOD OF MANUFACTURING A LIQUID DISCHARGE HEAD

(75) Inventors: Yoshiaki Suzuki, Yokohama (JP); Yoshinori Tagawa, Chigasaki (JP); Masashi Miyagawa, Yokohama (JP); Makoto Watanabe, Yokohama (JP); Tatsuya Masukawa, Kawasaki (JP); Yoshiaki Kurihara, Kawasaki (JP); Yasushi Iijima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

(21) Appl. No.: 09/587,054

(22) Filed: Jun. 2, 2000

(30) Foreign Application Priority Data

Jun. 4, 1999 (JP) ..... 11-158647

(51) Int. Cl.[7] ..... B21D 53/76; H05B 3/10

(52) U.S. Cl. ..... 29/890.1; 29/611; 29/DIG. 16; 347/56; 347/61; 347/65; 427/240; 427/553; 427/385.5; 427/407.1; 430/320

(58) Field of Search ..... 29/611, 890.1, 29/25.35, DIG. 16, 846; 347/56, 61, 62, 65; 427/240, 553, 555, 385.5, 407.1; 430/320, 322

(56) References Cited

U.S. PATENT DOCUMENTS

| | | | | |
|---|---|---|---|---|
| 3,974,508 A | | 8/1976 | Blumenthal | |
| 4,074,284 A | | 2/1978 | Dexter et al. | |
| 4,184,169 A | | 1/1980 | Taylor et al. | |
| 4,521,787 A | * | 6/1985 | Yokota et al. | 347/65 |
| 4,666,823 A | | 5/1987 | Yokota et al. | 430/320 |
| 5,278,585 A | | 1/1994 | Karz et al. | |
| 5,334,999 A | * | 8/1994 | Kashiwazaki et al. | 430/320 X |
| 5,478,606 A | | 12/1995 | Ohkuma et al. | 427/555 |
| 5,686,224 A | | 11/1997 | O'Neill | 430/320 |

FOREIGN PATENT DOCUMENTS

| | | | | |
|---|---|---|---|---|
| EP | 0818311 A | | 1/1998 | |
| EP | 819538 | | 1/1998 | |
| EP | 895861 | | 2/1999 | |
| EP | 1005996 | | 6/2000 | |
| JP | 6-106728 | * | 4/1994 | 29/890.1 |
| JP | 8-314148 | | 11/1996 | |

* cited by examiner

*Primary Examiner*—A. Dexter Tugbang
(74) *Attorney, Agent, or Firm*—Fitzpatrick, Cella, Harper & Scinto

(57) ABSTRACT

A method of manufacturing a liquid discharge head having an opening for discharging liquid droplets, a wall member constituting a liquid flow path to the opening, a substrate provided with and for creating a bubble in the liquid, and a movable member supported by and fixed to the substrate with the discharge opening side thereof as a free end displaced away from the substrate by pressure produced by creating the bubble to thereby direct the pressure to the discharge opening side including the steps of preparing the substrate and movable member, filling the gap between the movable member and the substrate with a liquid photo-curing resin, spin coating the resin until the resin covers the movable member, exposing an area of the resin to light to harden a portion corresponding to the wall member, and removing the unexposed portion of the photo-curing resin.

9 Claims, 12 Drawing Sheets

METHOD OF MANUFACTURING A LIQUID DISCHARGE HEAD

BACKGROUND OF THE INVENTION

1. Field of the Invention

This invention relates to a liquid discharge head for discharging desired liquid by the creation of a bubble occurring by heat energy being caused to act on the liquid, and a method of manufacturing such liquid discharge head. Particularly the present invention relates to a method of manufacturing a liquid discharge head having a movable member displaced by the utilization of the creation of a bubble, a liquid discharge head manufactured by the same method, and a method of manufacturing a minute mechanical apparatus.

Also, the present invention can be applied to apparatuses such as a printer for effecting recording on recording mediums such as paper, yarn, fiber, cloth, metals, plastics, glass wood and ceramics, a copier, a facsimile apparatus having a communication system and a word processor having a printer portion, and an industrial recording apparatus compositely combined with various processing apparatuses.

The term "recording" in the present invention means not only imparting meaningful images such as characters and figures to the recording mediums, but also imparting meaningless images such as patterns to the recording mediums.

2. Related Background Art

FIG. 12 of the accompanying drawings is a partly broken away perspective view showing a liquid discharge head according to the prior art.

As shown in FIG. 12, the liquid discharge head according to the prior art has a substrate 1004 on which a plurality of heaters 1005 which are bubble creating elements for giving head energy for creating bubbles in liquid are provided in parallel, and a top plate 1001 joined onto this substrate 1004.

The substrate 1004 comprises a base body of silicon or the like on which silicon oxide film or silicon nitride film are formed for the purposes of insulation and heat accumulation, and electrical resistance layers and wiring electrodes constituting the heaters 1005 being patterned thereon. By a voltage being applied from these wiring electrodes to the electrical resistance layers to thereby flow an electric current to the electrical resistance layers, the heaters 1005 generate heat. On the substrate 1004, there are provided packaging electrodes 1003 to which external terminals (not shown) for supplying an electric current to the heaters 1005 are connected.

The top plate 1001 is for constituting a plurality of liquid flow paths 1007 corresponding to the heaters 1005 and a common liquid chamber 1010 for supplying the liquid to the liquid flow paths 1007, and is integrally provided with flow path side walls 1001*a* extending from the ceiling portion thereof to among the heaters 1005. Also, the upper surface of the top plate 1001 is provided with an ink supply communication opening 1002 for causing the liquid supplied from the outside to flow into the common liquid chamber 1010. The top plate 1001 is formed of a silicon material, and the pattern of the liquid from paths 1007 and the common liquid chamber 1010 can be formed by etching, and the portions of the liquid flow paths 1007 can be etched and formed after a material such as silicon nitride or silicon oxide which provides the flow path side walls 1001*a* is accumulated on the silicon substrate by a conventional film forming method such as CVD.

A wall portion is provided on the fore end surface of the top plate 1001, and this wall portion is formed with a plurality of discharge openings 1006 corresponding to the respective liquid flow paths 1007 and communicating with the common liquid chamber 1010 through the liquid flow paths 1007.

FIG. 13 of the accompanying drawings is a partly broken away perspective view showing another example of the liquid discharge head according to the prior art.

The liquid discharge head shown in FIG. 13 is provided with cantilever-like movable members 2009 disposed in face-to-face relationship with heaters 2005. The movable members 2009 comprise thin film formed of a silicon material such as silicon nitride or silicon oxide or nickel or the like excellent in elasticity. These movable members 2009 are disposed at a predetermined distance from the heaters 2005 so as to have fulcrums upstream of the heaters 2005 and further have free ends downstream with respect to these fulcrums.

The top plate 2001, the ink supply communication opening 2002, the packaging electrodes 2003, the substrate 2004, the heaters 2005, the discharge openings 2006, the liquid flow paths 2007 and the common liquid chamber 2013 of the liquid discharge head are similar to those of the liquid discharge head shown in FIG. 12 and therefore need not be described in detail.

FIGS. 14A to 14D of the accompanying drawings are cross-sectional views along the direction of the flow paths for illustrating the liquid discharging method by the liquid discharge head shown in FIG. 13.

As shown in FIG. 14A, when the heater 2005 is caused to generate heat, the heat acts on the ink between the movable member 2009 and the heater 2005, whereby a bubble 2008 based on a film boiling phenomenon is created and grows on the heater 2005. Pressure resulting from the growth of this bubble 2008 preferentially acts on the movable member 2009, which is thus displaced so as to greatly open toward the discharge opening 2006 side about the fulcrum, as shown in FIG. 14B. By the displacement or displaced state of the movable member 2009, the propagation of the pressure based on the creation of the bubble 2008 or the growth of the bubble 2008 itself is directed to the discharge opening 2006 side, and the liquid (liquid droplet 2010) is discharged from the discharge opening 2006, as shown in FIG. 14C.

As described above, the movable member 2009 having a fulcrum on the upstream side (the common liquid chamber side) of the flow of the liquid in the liquid flow path 2007 and having a free end on the downstream side (the discharge opening 2006 side) thereof is provided on each heater 2005, whereby the direction of propagation of the pressure of the bubble 2008 is directed toward the downstream side and thus, the pressure of the bubble 2008 directly and efficiently contributes to discharge. The direction of growth itself of the bubble 2008, like the direction of propagation of the pressure of the bubble, is directed toward the downstream side, and the bubble grows larger on the downstream side than on the upstream side. The direction of the growth itself of the bubble 2008 is thus controlled by the movable member 2009 to thereby control the direction of propagation of the pressure of the bubble 2008, whereby fundamental discharge characteristics such as discharge efficiency and discharging force or discharge speed can be improved.

On the other hand, as shown in FIG. 14D, when the bubble 2008 enters its disappearing step, the bubble 2008 rapidly disappears by the combined effect with the elastic force of the movable member 2009 itself, and the movable member 2009 finally returns to its initial position shown in FIG. 14A. At this time, in order to make up for the contracted volume of the bubble and to make up for the discharged volume of the liquid, the liquid flows from the upstream side, i.e., the common liquid chamber side, and the refilling of the liquid flow path 2007 with the liquid is effected, and this refilling with the liquid is effected efficiently and rationally with the returning action of the movable member 2009.

In a method of manufacturing a liquid discharge head according to the prior art shown in FIG. 15 of the accompanying drawings, movable members 2009 are first formed on a substrate 2004 on which heaters 2005, etc. are provided. The movable members 2009 are made by a series of semiconductor processes comprising, for example, the formation of a sacrifice layer aluminum pattern, the formation of SiN layers forming the movable members 2009 and the patterning of the SiN layers. As described above, devices such as the movable members are provided on the surface of the substrate 2004 and thus, the surface of the substrate 2004 has unevenness of a height of the order of 3 to 10 $\mu$m.

Next, a nozzle wall member 2010 for constituting liquid flow paths 2007 and a common liquid chamber 2013 (see FIG. 13 for both) between the substrate 2004 and a top plate 2001 is joined onto the substrate 2004. The upper surface of the nozzle wall member 2010 to which the top plate 2001 is to be joined is then flattened.

Next, the top plate 2001 is joined to the upper surface of the nozzle wall member 2010, and an orifice plate 2011 formed with discharge openings 2006 is joined to an end surface in which the liquid flow paths 2007 open. By the above-described steps, the liquid discharge head according to the prior art shown in FIG. 13 is manufactured.

However, in the manufacturing method described with reference to FIG. 15, it is necessary to accurately join the nozzle wall member 2010 onto the substrate 2004 and further, it is necessary to flatten the upper surface of the nozzle wall member 2010 before the joining of the top plate 2001 and therefore, the manufacturing steps have been cumbersome.

Also, when this wall member is to be formed of an organic material, thick film of the above-mentioned thickness can be formed if dry film is used, but the surface of the substrate is uneven as described above and therefore, not only it has been difficult to achieve the flattening of the upper surface of the wall member, but there has been the fear that the movable members are deformed by the dry film. Further, it has been difficult to form thick film of a thickness of several tens of $\mu$m, by the use of the conventional wet process.

SUMMARY OF THE INVENTION

So, the present invention has as its object to provide a liquid discharge head in which the upper surface of a wall member can be flattened and the manufacturing time for which can be shortened and which is provided with a wall member formed into thick film having a thickness of several tens of $\mu$m, a method of manufacturing the liquid discharge head, a minute mechanical apparatus and a method of manufacturing the minute mechanical apparatus.

To achieve the above object, the liquid discharge head of the present invention is a liquid discharge head having a discharge opening for discharging liquid droplets therefrom, a wall member constituting a liquid flow path communicating with the discharge opening to supply liquid to the discharge opening, a substrate provided with a bubble creating element for creating a bubble in the liquid filling the liquid flow path, and a movable member supported by and fixed to the substrate with the discharge opening side thereof as a free end at a position on the substrate which faces the bubble creating element with a gap between it and the substrate, the free end of the movable member being displaced in a direction opposite to the substrate by pressure produced by creating the bubble, and the pressure being directed to the discharge opening side to thereby discharge the droplet of the liquid from the discharge opening, characterized in that the wall member is constructed by providing and patterning liquid resin of a negative type hardened when exposed to light on a surface on which the movable member is formed.

According to the liquid discharge head constructed as described above, as compared with a case where an inorganic material such as SiN or SiO is formed into film to thereby form a wall member, it becomes possible to shorten the manufacturing time. Further, according to the present invention, the wall member is formed by exposing a predetermined portion of resin of the negative type applied onto the substrate to light to thereby harden it and therefore, unlike the conventional wet process, it becomes possible to form thick film having a thickness of several tens of $\mu$m.

Also, preferably the wall member may be of a construction formed by a forming method having the step of applying the liquid resin to that surface of the substrate on which the movable member is provided by spin coating, the step of exposing to light and hardening that portion of the applied resin which constitutes the wall member, and the step of removing that portion of the applied resin which is not hardened.

Further, the forming method has the step of effecting the baking of the resin at a temperature equal to or higher than the melting point of the hardened resin after the step of removing that portion of the applied resin which is not hardened, whereby the levelling flow of the upper surface of the wall member is effected highly accurately. Therefore, it is not necessary to flatten the upper surface of the wall member by polishing or the like which is a post-step, and the manufacturing steps for the liquid discharge head are simplified and further, it becomes possible to manufacture the liquid discharge head inexpensively.

Furthermore, by adopting a construction in which the resin contains a solid component of 50% or more and the average molecular weight thereof is 10,000 or less, the viscosity of the resin becomes relatively low and it becomes possible to flatten the resin well at the applying step by spin coating and also, the resin can be made to flow well into the gap between the substrate and the movable member. Therefore, the possibility of flexure or bending occurring to the movable member when the resin is applied by spin coating can be reduced.

Also, the method of manufacturing a liquid discharge head of the present invention is a method of manufacturing a liquid discharge head having a discharge opening for discharging liquid droplets therefrom, a wall member constituting a liquid flow path communicating with the discharge opening to supply liquid to the discharge opening, a substrate provided with a bubble creating element for creating a bubble in the liquid filling the liquid and flow path, and a movable member supported by and fixed to the substrate with the discharge opening side thereof as a free end at a position on the substrate which faces the bubble creating element with a gap between it and the substrate, the free end of the movable member being displaced in a direction opposite to the substrate by pressure created by creating the bubble, and the pressure being directed to the discharge opening side to thereby discharge the droplet of the liquid from the discharge opening, characterized by the step of using resin of a negative type hardened when exposed to light as a material forming the wall member, and applying the liquid resin to that surface of the substrate on which the movable member is provided by spin coating, the step of exposing to light and hardening that portion of the applied resin which constitutes the wall member, and the steps of removing that portion of the applied resin which is not hardened.

Thereby, as compared with a case where an inorganic material such as SiN or SiO is formed into film to thereby form a wall member, the manufacturing time is shorted and further, unlike the conventional wet process, it becomes possible to form thick film of a thickness of several tens of $\mu$m.

Further, there may be adopted a construction having the step of effecting the baking of the resin at a temperature equal to or higher than the fusing point of the hardened resin after the step of removing that portion of the applied resin which is not hardened.

Furthermore, there may be adopted a construction in which the resin contains a solid component of 50% or more and the average molecular weight thereof is 10,000 or less.

Also, the minute mechanical apparatus of the present invention is a minute mechanical apparatus having a first substrate on the surface of which a wall member constituting a liquid flow path is provided, a movable member supported by and fixed to the first substrate with one end portion thereof as a free end with a gap between it and the first substrate in the liquid flow path on the first substrate, and a second substrate joined to the upper surface of the wall member, characterized in that the wall member is constructed by liquid resin of a negative type hardened when exposed to light being provided and patterned on that surface of the first substrate on which the movable member is formed.

Further, preferably the resin may contain a solid component of 50% or more and the average molecular weight thereof may be 10,000 or less.

Also, the method of manufacturing a minute mechanical apparatus of the present invention is a method of manufacturing a minute mechanical apparatus having a first substrate on the surface of which a wall member constituting a liquid flow path is provided, a movable member supported by and fixed to the first substrate with one end portion thereof as a free end with a gap between it and the first substrate in the liquid flow path on the first substrate, and a second substrate joined to the upper surface of the wall member, characterized by the step of using resin of a negative type hardened when exposed to light as a material forming the wall member, and applying the liquid resin to that surface of the substrate on which the movable member is provided by spin coating, the step of exposing to light and hardening that portion of the applied resin which constitutes the wall member, and the step of removing that portion of the applied resin which is not hardened.

Preferably there may be adopted a construction having the step of effecting the baking of the resin at a temperature equal to or higher than the melting point of the hardened resin after the step of removing that portion of the applied resin which is not hardened.

DESCRIPTION OF THE PREFERRED EMBODIMENTS

As an embodiment applicable to the present invention, description will now be made of a liquid discharge head having a plurality of discharge openings for discharging liquid therefrom, a first substrate and a second substrate joined to each other to thereby constitute a plurality of liquid flow paths communicating with the respective discharge openings, a plurality of energy conversion elements disposed in the respective liquid flow paths to convert electrical energy into the discharge energy of the liquid in the liquid flow paths, and a plurality of elements or electric circuits differing in function from one another for controlling the driving condition of the energy conversion elements, the elements or the electric circuits being allotted to the first substrate and the second substrate in conformity with the functions thereof.

Figure 1:
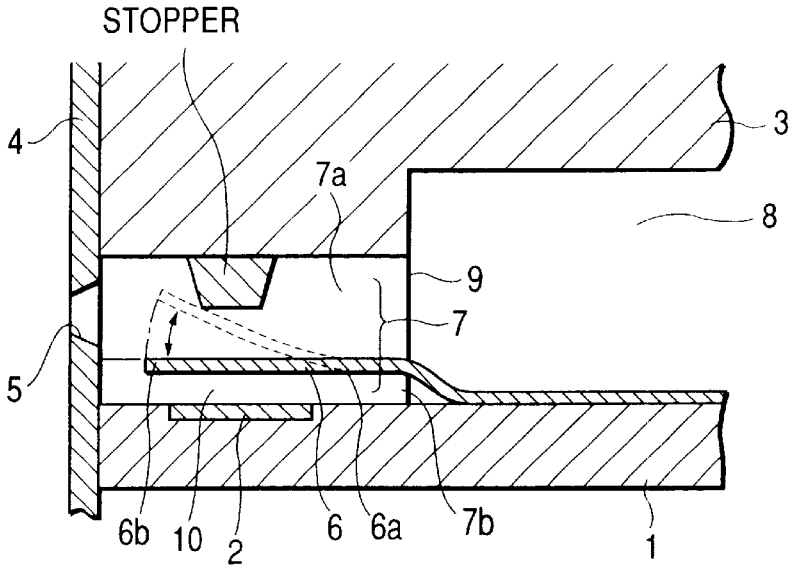
FIG. 1 is a cross-sectional view along the direction of a liquid flow path for illustrating the structure of a liquid discharge head which is an embodiment of the present invention.

FIG. 1 is a cross-sectional view along the direction of the liquid flow paths of a liquid discharge head which is an embodiment of the present invention.

As shown in FIG. 1, this liquid discharge head has an element substrate 1 on which a plurality (only one of which is shown in FIG. 1) of heat generating members 2 for giving heat energy for creating a bubble in liquid are provided in parallel, a top plate 3 joined onto this element substrate 1, an orifice plate 4 joined to the fore end surfaces of the element substrate 1 and the top plate 3, and a movable member 6 installed in a liquid flow path 7 constituted by the element substrate 1 and the top plate 3.

The element substrate 1 comprises a substrate of silicon or the like and silicon oxide film or silicon nitride film directed to insulation and heat accumulation and formed thereon, and electrical resistance layers and wiring constituting the heat generating members 2 and patterned thereon. A voltage is applied from this wiring to the electrical resistance layers to thereby flow an electric current to the electrical resistance layers, whereby the heat generating members 2 generate heat.

The top plate 3 is for constructing a plurality of liquid flow paths 7 corresponding to the respective heat generating members 2 and a common liquid chamber 8 for supplying the liquid to the liquid flow paths 7 between it and the element substrate 1. Flow path side walls 9 constituting the plurality of liquid flow paths 7 and the common liquid chamber 8 on the element substrate 1 are formed of photosensitive epoxy resin of a negative type on the element substrate 1, as will be described later with reference to FIG. 16 and FIGS. 9A to 9C.

The orifice plate 4 is formed with a plurality of discharge openings 5 corresponding to the liquid flow paths 7 and communicating with the common liquid chamber 8 through the liquid flow paths 7. The orifice plate 4 is also formed of a silicon material, and is formed, for example, by planing a silicon substrate formed with the discharge openings 5 to a thickness of the order of 10 to 150 $\mu$m. The orifice plate 4 is not always a construction necessary to the present invention, and instead of providing the orifice plate 4, a wall corresponding to the thickness of the orifice plate 4 can be left on the fore end surface of the top plate 3 when the liquid flow paths 7 are formed in the top plate 3, and the discharge openings 5 can be formed in this portion to thereby provide a top plate formed with discharge openings.

The movable member 6 is cantilever-like thin film disposed in face-to-face relationship with the heat generating member 2 so as to divide each liquid flow path 7 into a first liquid flow path 7*a* communicating with the discharge opening 5 and a second liquid flow path 7*b* having the heat generaitng member 2, and is formed of a silicon material such as silicon nitride or silicon oxide.

This movable member 6 is disposed at a predetermined distance from the heat generating member 2 in such a state that it covers the heat generating member 2 at a position facing the heat generating member 2 so as to have a fulcrum 6*a* on the upstream side of a great flow flowing from the common liquid chamber 8 to the discharge opening 5 side via the movable member 6 by the discharging action of the liquid, and to have a free end 6*b* on the downstream side with respect to this fulcrum 6*a*. The space between the heat generating member 2 and the movable member 6 is a bubble creating area 10.

When the heat generating member 2 is made to generate heat on the basis of the above-described construction, the heat acts on the liquid in the bubble creating area 10 between the movable member 6 and the heat generating member 2, whereby a bubble based on the film boiling phenomenon is created on the heat generating member 2, and grows. Pressure resulting from the growth of this bubble preferentially acts on the movable member 6, which is thus displaced so as to greatly open toward the discharge opening 5 side about the fulcrum 6*a*, as indicated by broken line in FIG. 1. By the displacement or displaced state of the movable member 6, the propagation of the pressure based on the creation of the bubble or the growth of the bubble itself is directed to the discharge opening 5 side, and the liquid is discharged from the discharge opening 5.

That is, the movable member 6 having the fulcrum 6*a* on the upstream side (the common liquid chamber 8 side) of the flow of the liquid in the liquid flow path 7 and having the free end 6*b* on the downstream side (the discharge opening 5 side) thereof is provided on the bubble creating area 10, whereby the direction of propagation of the pressure of the bubble is directed to the downstream side, and thus the pressure of the bubble directly and efficiently contributes to the discharge. The direction of growth itself of the bubble, like the direction of propagation of the pressure, is also directed in the downstream direction, and the bubble grows more greatly on the downstream side than on the upstream side. As described above, the direction of growth itself of the bubble is controlled by the movable member to thereby control the direction of propagation of the pressure of the bubble, whereby fundamental discharging characteristics such as the discharge efficiency and the discharging force or the discharge speed can be improved.

On the other hand, when the bubble enters the disappearing step, the bubble rapidly disappears by the combined effect with the elastic force of the movable member 6, and the movable member 6 finally returns to its initial position indicated by solid line in FIG. 1. At this time, in order to make up for the contracted volume of the bubble in the bubble creating area 10 and the make up for the discharged volume of the liquid, the liquid flows in from the upstream side, i.e., the common liquid chamber 8 side, whereby the refilling of the liquid flow path 7 with the liquid is effected, and this refilling with the liquid is effected efficiently and rationally and stably with the returning action of the movable member 6.

Also, the liquid discharge head of the present embodiment has circuits and elements for controlling the driving of the heat generating members 2. These circuits and elements are divisionally disposed on the element substrate 1 or the top plate 3 in conformity with the functions thereof. Also, these circuits and elements can be formed easily and minutely by the use of the semiconductor wafer process technique because the element substrate 1 and the top plate 3 are formed of a silicon material.

Description will hereinafter be made of the structure of the element substrate 1 formed by the use of the semiconductor wafer process technique.

Figure 2:
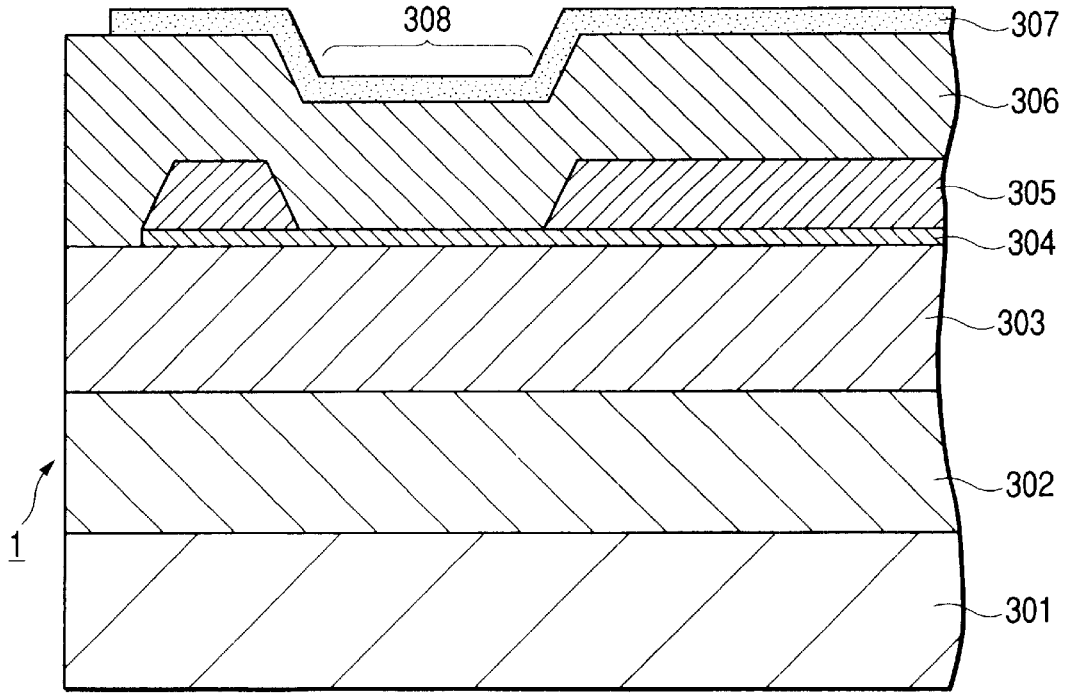
FIG. 2 is a cross-sectional view of an element substrate used in the liquid discharge head shown in FIG. 1.

FIG. 2 is a cross-sectional view of the element substrate used in the liquid discharge head shown in FIG. 1. As shown in FIG. 2, in the element substrate 1 used in the liquid discharge head of the present embodiment, heat-oxidized film 302 as a heat accumulating layer and inter-layer film 303 serving also as a heat accumulating layer are layered in the named order on the surface of a silicon substrate 301. $SiO_2$ film or $Si_3N_4$ film is used as the inter-layer film 303. A resistance layer 304 is partly formed on the surface of the inter-layer film 303, and wiring 305 is partly formed on the surface of the resistance layer 304. Al alloy wiring of Al—Si, Al—Cu or the like is used as the wiring 305. Protective film 306 comprising $SiO_2$ film or $Si_3N_4$ film is formed on the surfaces of the wiring 305, the resistance layer 304 and the inter-layer film 303. Cavitation resisting film 307 for protecting the protective film 306 from chemical and physical shocks resulting from the heating of the resistance layer 304 is formed on and around that portion of the surface of the protective film 306 which corresponds to the resistance layer 304. That area of the surface of the resistance layer 304 on which the wiring 305 is not formed is a heat acting portion 308 which is a portion on which the heat of the resistance layer 304 acts.

The film on this element substrate 1 is formed on the surface of the silicon substrate 301 by the semiconductor manufacturing technique, and the heat acting portion 308 is provided on the silicon substrate 301.

Figure 3:
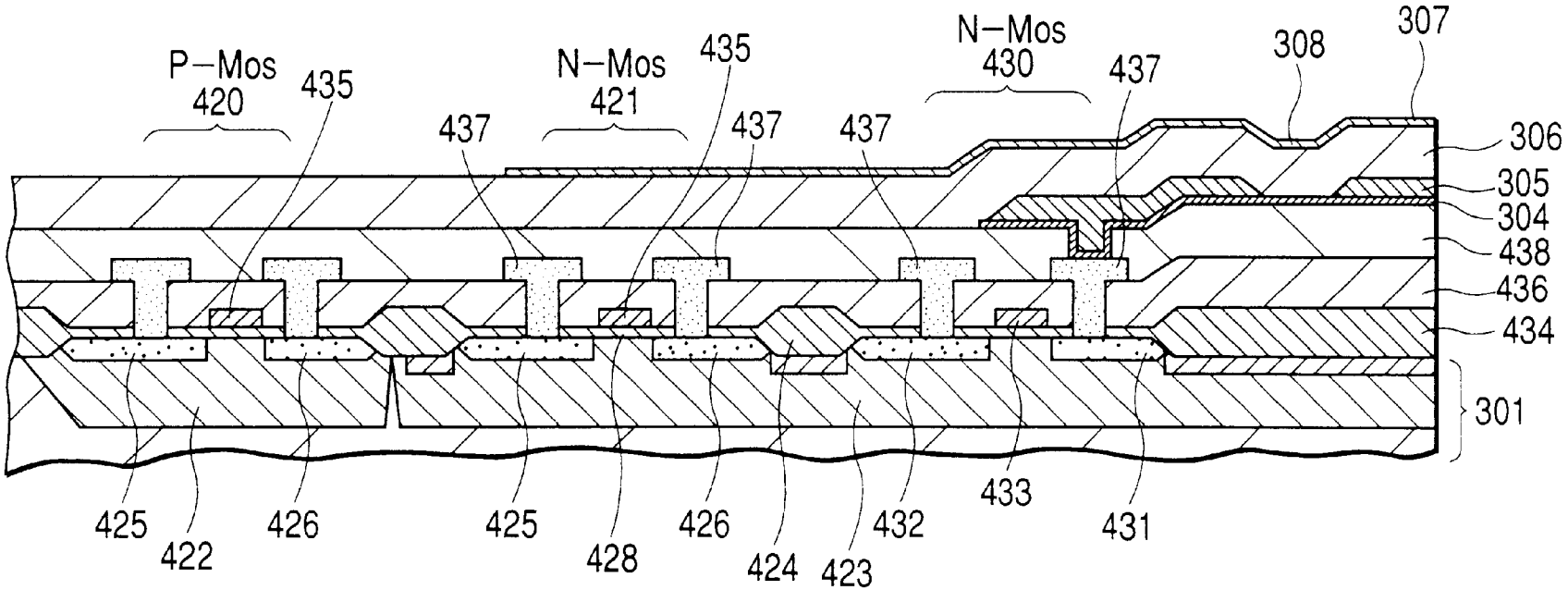
FIG. 3 is a typical cross-sectional view in which the element substrate shown in FIG. 2 is sectioned so as to cut the main elements of the element substrate longitudinally.

FIG. 3 is a typical cross-sectional view in which the element substrate 1 as shown in FIG. 2 is sectioned so as to cut the main elements of the element substrate longitudinally.

As shown in FIG. 3, an N type well area 422 and a P type well area 423 are partly provided on the surface layer of the silicon substrate 301 which is a P conductor. By the use of a general Mos process, P-Mos 420 and N-Mos 421 are provided on the N type well area 422 and the P type well area 423, respectively, by the introduction and diffusion of impurities such as ion implantation. P-Mos 420 is comprised of a source area 425 and a drain area 426 formed by N type or P type impurities being partly introduced into the surface layer of the N type well area 422, gate wiring 435 piled up on the surface of that portion of the N type well area 422 except the source area 425 and the drain area 426 through gate insulating film 428 having a thickness of several hundreds of Å, etc. Also, N-Mos 421 is comprised of a source area 425 and a drain area 426 formed by N type or P type impurities being partly introduced into the surface layer of the P type well area 423, gate wiring 435 piled up on the surface of that portion of the P type well area 422 except the source area 425 and the drain area 426 through gate insulating film 428 having a thickness of several hundreds of Å, etc. The gate wiring 435 is formed of polysilicon of a thickness of 4000 Å to 5000 Å piled up by the CVD method. C-Mos logic is comprised of the P-Mos 420 and the N-Mos 421.

An N-Mos transistor 430 for driving an electro-thermal conversion element is provided on that portion of the P type well area 423 which differs from the N-Mos 421. The N-Mos transistor 430 is also comprised of a source area 432 and a drain area 431 partly provided on the surface layer of the P type well area 423 by the steps of introducing and diffusing impurities, gate wiring 433 piled up on the surface of that portion of the P type well area 423 except the source area 432 and the drain area 431 through the gate insulating film 428, etc.

While in the present embodiment, the N-Mos transistor 430 is used as the transistor for driving the electro-thermal conversion element, the transistor is not restricted to this transistor if it is a transistor having the capability of individually driving a plurality of electro-thermal conversion elements and capable of obtaining the minute structure as described above.

Between the elements such as between the P-Mos 420 and the N-Mos 421 and between the N-Mos 421 and the N-Mos transistor 430, an oxidized film separating area 424 is formed by field oxidization of a thickness of 5000 Å to 10000 Å, and the elements are separated by the oxidized film separating area 424. That portion of the oxidized film separating area 424 which corresponds to the heat acting portion 308 plays the role as the first heat accumulating layer 434 as viewed from the surface side of the silicon substrate 301.

Inter-layer insulating film 436 comprising PSG film or BPSG film having a thickness of about 7000 Å is formed on the surface of each of the P-Mos 420, the N-Mos 421 and the N-Mos transistor 430 by the CVD method. After the inter-layer insulating film 436 has been flattened by heat treatment, wiring is effected by an Al electrode 437 which is a first wiring layer through a contact hole extending through the inter-layer insulating film 436 and the gate insulating film 428. Inter-layer insulating film 438 comprising $SiO_2$ film having a thickness of 10000 Å to 15000 Å is formed on the surfaces of the inter-layer insulating film 436 and the Al electrode 437 by the plasma CVD method. A resistance layer 304 comprising $TaN_{0.8,\ hex}$ film having a thickness of about 1000 Å A is formed on that portion of the surface of the inter-layer insulating film 438 which corresponds to the heat acting portion 308 and the N-Mos transistor 430 by the DC sputter method. The resistance layer 304 is electrically connected to the Al electrode 437 near the drain area 431 through a through-hole formed in the inter-layer insulating film 438. Al wiring 305 as a second wiring layer which provides wiring to each electro-thermal conversion element is formed on the surface of the resistance layer 304.

Protective film 306 on the surfaces of the wiring 305, the resistance layer 304 and the inter-layer insulating film 438 comprises $Si_3N_4$ film having a thickness of 10000 Å formed by the plasma CVD method. Cavitation resisting film 307 formed on the surface of the protective film 306 comprises film of Ta or the like having a thickness of about 2500 Å.

Figure 4:
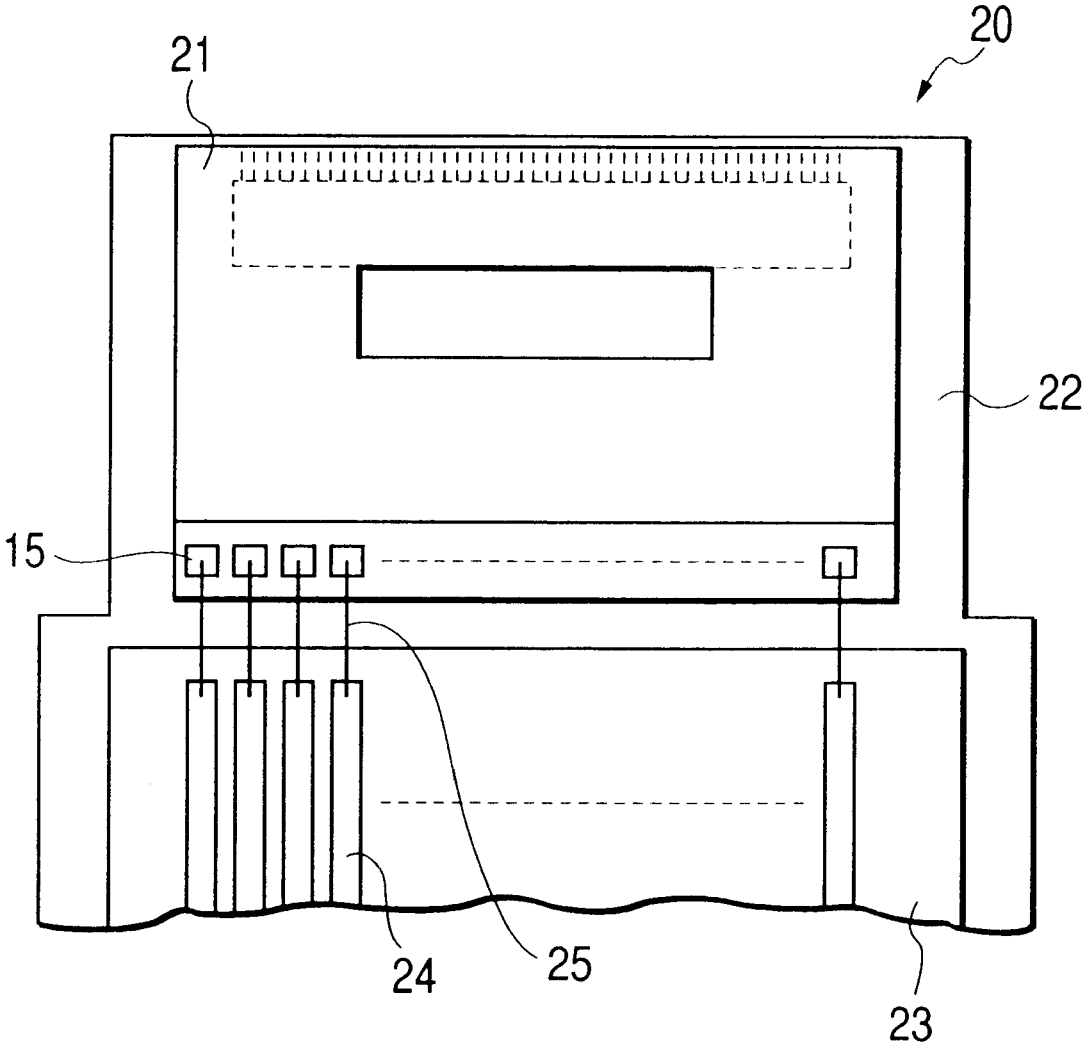
FIG. 4 is a plan view of a liquid discharge head unit carrying thereon the liquid discharge head shown in FIG. 1.

When the liquid discharge head obtained in this manner is to be carried on a head cartridge or a liquid discharge apparatus, it is fixed onto a base substrate 22 on which a printed wiring substrate 23 is carried, and is made into a liquid discharge head unit 20, as shown in FIG. 4. In FIG. 4, a plurality of wiring patterns 24 electrically connected to the head controlling portion of the liquid discharge apparatus are provided on the printed wiring substrate 23, and these wiring patterns 24 are electrically connected to external contact pads 15 through bonding wires 25. The external contact pads 15 are provided on only the element substrate 1 and therefore, the electrical connection between the liquid discharge head 21 and the outside can be made in a manner similar to that in the prior-art liquid discharge head. While herein, the external contact pads 15 have been described as being provided on the element substrate 1, they may be provided not on the element substrate 1, but on only the top plate.

Description will now be made of a method of manufacturing the movable member on the element substrate which utilizes the photolithography process.

FIGS. 5A to 5E are views for illustrating an example of the method of manufacturing the movable member 6 on the liquid discharge head described with reference to FIG. 1, and in FIGS. 5A to 5E, there is shown a cross-section along the direction of the flow path of the liquid flow path 7 shown in FIG. 1. In the manufacturing method to be described with reference to FIGS. 5A to 5E, the movable member 6 formed on the element substrate 1 and the flow path side walls formed on the top plate are joined together to thereby manufacture the liquid discharge head of the construction shown in FIG. 1. Accordingly, in this manufacturing method, the flow path side walls are made in the top plate before the top plate is joined to the element substrate 1 on which the movable member 6 is made.

Figure 5A:
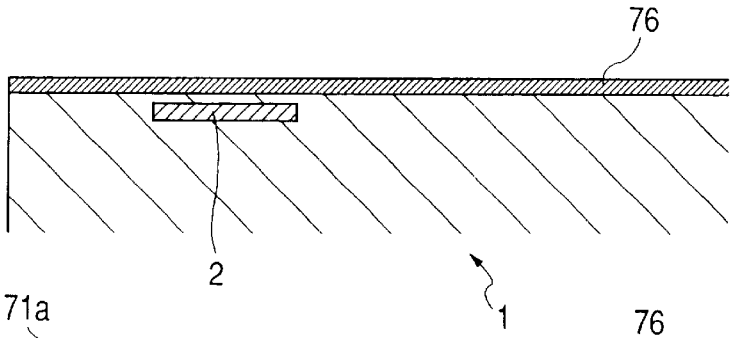
FIGS. 5A, 5B, 5C, 5D and 5E are views for illustrating a method of forming a movable member on the element substrate.

First, in FIG. 5A, on the whole of that surface of the element substrate 1 which is adjacent to the heat generating member 2, TiW film 76 as a first protective layer for protecting a connecting pad portion for making electrical connection to the heat generating member 2 is formed to a thickness of about 5000 Å by the sputtering method.

Figure 5B:
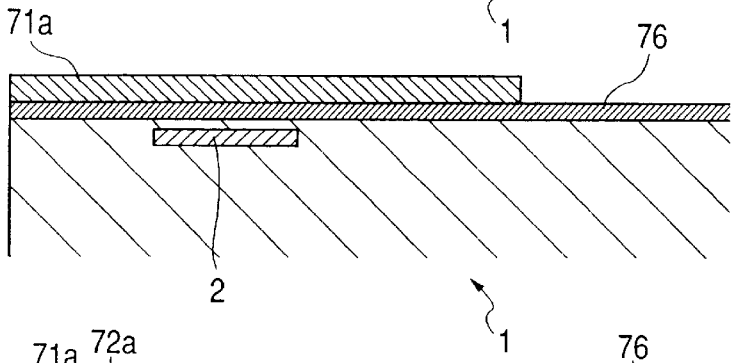

Next, in FIG. 5B, on the surface of the TiW film 76, Al film for forming a gap forming member 71*a* is formed to a thickness of about 4 μm by the sputtering method. The gap forming member 71*a* extends to an area in which SiN film 72*a* is etched at the step of FIG. 5D which will be described later.

The formed Al film is patterned by the use of the well known photolithography process, to thereby remove only that portion of the Al film which corresponds to the supported and fixed portion of the movable member 6, and the gap forming member 71*a* is formed on the surface of the TiW film 76. Thus, that portion of the surface of the TiW film 76 which corresponds to the supported and fixed portion of the movable member 6 becomes exposed. This gap forming member 71*a* comprises Al film for forming the gap between the element substrate 1 and the movable member 6. The gap forming member 71*a* is formed on all of that portion of the surface of the TiW film 76 including a position corresponding to the bubble creating area 10 between the heat generating member 2 and the movable member 6 shown in FIG. 1 and excluding the portion corresponding to the supported and fixed portion of the movable member 6. Accordingly, in this manufacturing method, the gap forming member 71*a* is formed to that portion of the surface of the TiW film 76 which corresponds to the flow path side walls.

This gap forming member 71*a*, as will be described later, functions as an etching stop layer when the movable member 6 is formed by drying etching. This is because the TiW film 76, the Ta film as the cavitation resisting film on the element substrate 1 and the SiN film as the protective layer on the resistance member are etched by an etching gas used to form the liquid flow path 7, and in order to prevent the etching of those layers and film, such a gap forming member 71*a* is formed on the element substrate 1. Thereby, the surface of the TiW film 76 is not exposed when the dry etching of the SiN film is effected to form the movable member 6, and the injury of the TiW film 76 and the functional elements in the element substrate 1 by the dry etching is prevented by the gap forming member 71*a*.

Figure 5C:
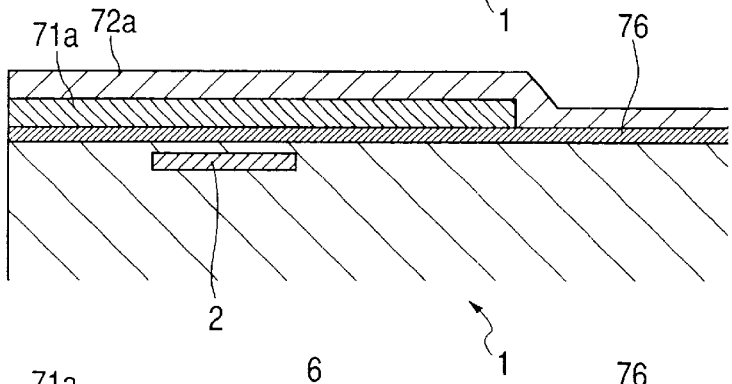

Next, in FIG. 5C, on the whole of the surface of the gap forming member 71*a* and the whole of the exposed surface of the TiW film 76, SiN film 72*a* having a thickness of about 4.5 μm which is material film for forming the movable member 6 is formed so as to cover the gap forming member 71*a*, by the use of the plasma CVD method. Here, when the SiN film 72*a* is to be formed by the use of a plasma CVD apparatus, as will be described next with reference to FIG. 6, the cavitation resisting film formed of Ta provided on the element substrate 1 is grounded through the silicon substrate or the like constituting the element substrate 1. Thereby, the functional elements such as the heat generating members 2 and a latch circuit in the element substrate 1 can be protected against the charges of ion species and radicals decomposed by the plasma discharge in the reaction chamber of the plasma CVD apparatus.

Figure 6:
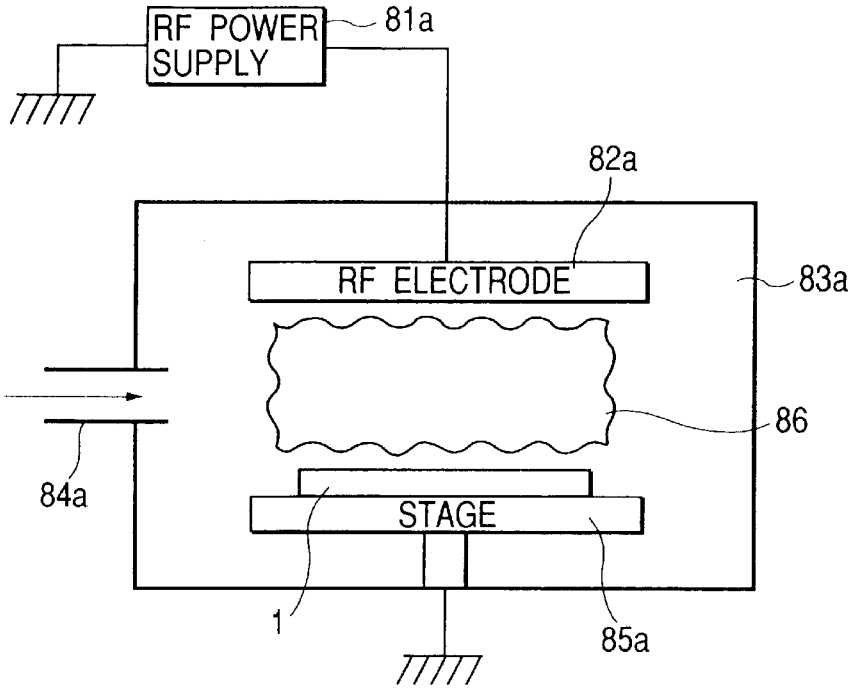
FIG. 6 is a view for illustrating a method of forming SiN film on the element substrate by the use of a plasma CVD apparatus.

As shown in FIG. 6, an RF electrode 82*a* and a stage 85*a* opposed to each other at a predetermined distance are provided in the reaction chamber 83*a* of the plasma CVD apparatus for forming the SiN film 72*a*. A voltage is applied to the RF electrode 82*a* by an RF power supply 81*a* outside the reaction chamber 83*a*. On the other hand, the element substrate 1 is mounted on that surface of the stage 85*a* which is adjacent to the RF electrode 82*a*, and that surface of the element substrate 1 which is adjacent to the heat generating member 2 is opposed to the RF electrode 82*a*. Here, the cavitation resisting film comprising Ta formed on the surface of the heat generating member 2 the element substrate 1 has is electrically connected to the silicon substrate of the element substrate 1, and the gap forming member 71*a* is grounded through the silicon substrate of the element substrate 1 and the stage 85*a*.

In the plasma CVD apparatus constructed as described above, a gas is supplied into the reaction chamber 83*a* through a supply tube 84*a* in a state in which the cavitation resisting film is grounded, and plasma 46 is generated between the element substrate 1 and the RF electrode 82*a*. Ion species and radicals decomposed by plasma discharge in the reaction chamber 83*a* are piled up on the element substrate 1, whereby the SiN film 72*a* is formed on the element substrate 1. At that time, charges are generated on the element substrate 1 by the ion species and radicals, but by the cavitation resisting film being grounded as described above, the functional elements such as the heat generating elements 2 and the latch circuit in the element substrate 1 are prevented from being injured by the charges of the ion species and radicals.

Figure 5D:
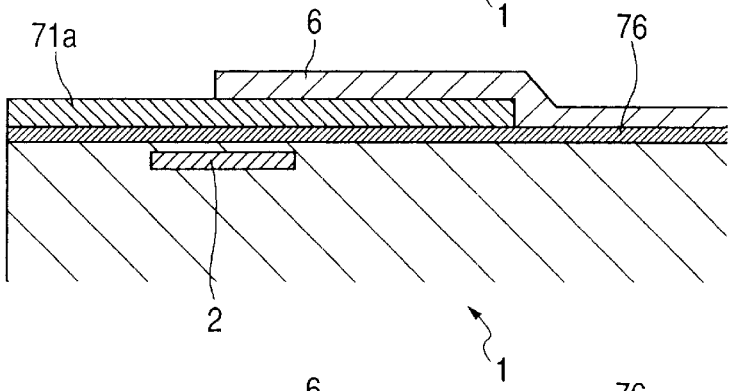

Next, in FIG. 5D, Al film is formed to a thickness of about 6100 Å on the surface of the SiN film 72*a* by the sputtering method, whereafter the formed Al film is patterned by the use of the well known photolithography process, and Al film (not shown) as a second protective layer is left on that portion of the surface of the SiN film 72*a* which corresponds to the movable member 6. The Al film as the second protective layer becomes a protective layer (etching stop layer), i.e. a mask, when the dry etching of the SiN film 72*a* is effected to form the movable member 6.

Then, by the use of an etching apparatus using dielectric coupling plasma, the SiN film 72*a* is patterned with the aforementioned second protective layer as a mask, to thereby form the movable member 6 constituted by the left portion of the SiN film 72*a*. In the etching apparatus, mixed gases of $CF_4$ and $O_2$ are used, and at the step of patterning the SiN film 72*a*, as shown in FIG. 1, the unnecessary portion of the SiN film 72*a* is removed so that the supported and fixed portion of the movable member 6 may be directly fixed to the element substrate 1. TiW which is the constituent material of the pad protecting layer and Ta which is the constituent material of the cavitation resisting film of the element substrate 1 are contained in the constituent material of the closely contacting portion between the supported and fixed portion of the movable member 6 and the element substrate 1.

Here, when the SiN film 72*a* is to be etched by the use of a dry etching apparatus, the gap forming member 71*a* is grounded through the element substrate 1 or the like as will be described next with reference to FIG. 7. Thereby, the charges of ion species and radicals produced by the decomposition of $CF_4$ gas during dry etching can be prevented from staying on the gap forming member 71*a* to thereby protect the functional elements such as the heat generating elements 2 and the latch circuit in the element substrate 1. Also, in a portion exposed by the unnecessary portion of the SiN film 72*a* being removed at this etching step, i.e., an etched area, the gap forming member 71*a* is formed as described above and therefore, the surface of the TiW film 76 is not exposed and the element substrate 1 is reliably protected by the gap forming member 71*a*.

Figure 7:
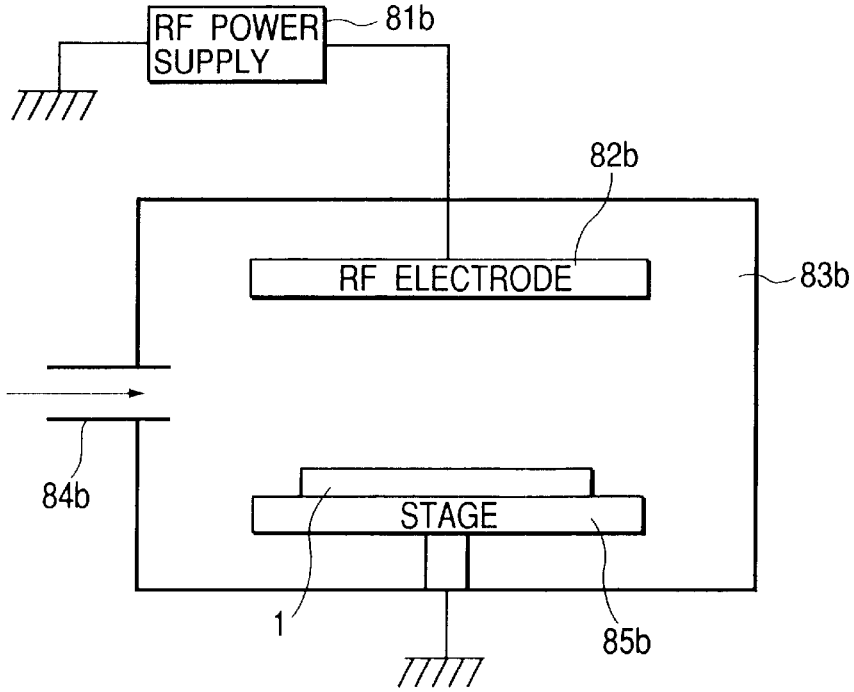
FIG. 7 is a view for illustrating a method of forming SiN film by the use of a dry etching apparatus.

As shown in FIG. 7, an RF electrode 82*b* and a stage 85*b* opposed to each other with a predetermined distance therebetween are provided in the reaction chamber 83*b* of the dry etching apparatus for etching the SiN film 72*a*. A voltage is applied to the RF electrode 82*b* by an RF power supply 81*b* outside the reaction chamber 83*b*. On the other hand, the element substrate 1 is mounted on that surface of the stage 85*b* which is adjacent to the RF electrode 82*b*, and that surface of the element substrate 1 which is adjacent to the heat generating member 2 is opposed to the RF electrode 82*b*. Here, the gap forming member 71*a* comprising Al film is electrically connected to cavitation resisting film formed of Ta provided on the element substrate 1, and the cavitation resisting film is electrically connected to the silicon substrate of the element substrate 1, as previously described, and the gap forming member 71*a* is grounded through the cavitation resisting film and the silicon substrate of the element substrate 1 and the stage 85*b*.

In the dry etching apparatus constructed as described above, mixed gases of $CF_4$ and $O_2$ are supplied into the reaction chamber 83*a* through a supply tube 84*a* with the gap forming member 71*a* grounded, and the etching of the SiN film 72*a* is effected. At that time, charges are produced on the element substrate 1 by ion species and radicals produced by the decomposition of the $CF_4$ gas, but as described above, the gap forming member 71*a* is grounded, whereby the functional elements such as the heat generating members 2 and the latch circuit in the element substrate 1 are prevented from being injured by the charges of the ion species and radicals.

While in the present embodiment, the mixed gases of $CF_4$ and $O_2$ are used as the gas supplied into the reaction chamber 83*a*, $CF_4$ gas or $C_2F_6$ gas with which $O_2$ is not mixed, or mixed gases of $C_2F_6$ and $O_2$ may also be used.

Figure 5E:
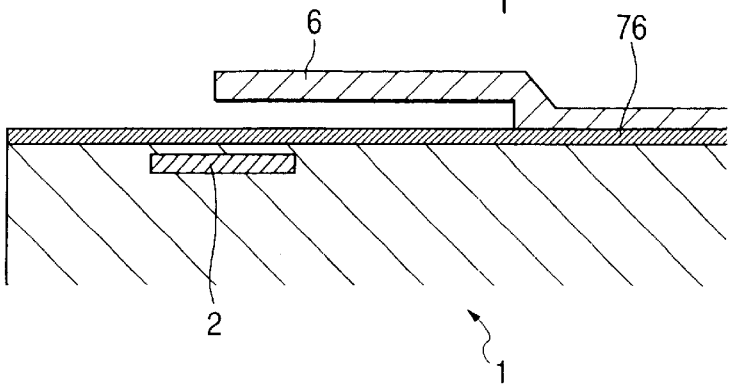

Next, in FIG. 5E, the second protective layer comprising Al film formed on the movable member 6 and the gap forming member 71*a* comprising Al film are eluted and removed by the use of mixed acids of acetic acid, phosphoric acid and nitric acid, and the movable member 6 is made on the element substrate 1. Thereafter, those portions of the TiW film 76 formed on the element substrate 1 which correspond to the bubble creating area 10 and the pads are removed by the use of hydrogen peroxide.

The element substrate 1 on which the movable member 6 is provided is manufactured in the manner described above. Herein, description has been made with respect to a case where a liquid discharge head in which as shown in FIG. 1, the supported and fixed portion of the movable member 6 is directly fixed to the element substrate 1 is manufactured, but this manufacturing method can be applied to manufacture a liquid discharge head in which the movable member is fixed to the element substrate with a pedestal portion interposed therebetween. In this case, before the step of forming the gap forming member 71*a* shown in FIG. 5B, a pedestal portion for fixing that end portion of the movable member which is opposite to the free end to the element substrate is formed on that surface of the element substrate which is adjacent to the heat generating member. Again in this case, TiW which is the constituent material of the pad protecting layer and Ta which is the constituent material of the cavitation resisting film of the element substrate are contained in the constituent material of the close contact portion between the pedestal portion and the element substrate.

Figure 8A:
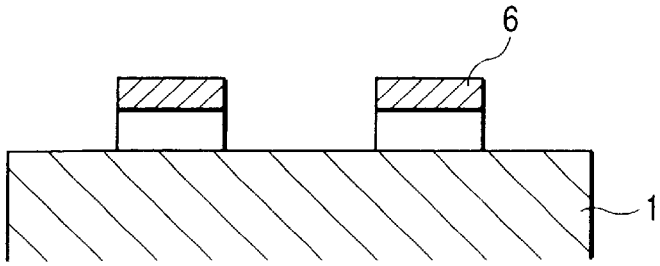
FIGS. 8A, 8B, 8C and 8D are step cross-sectional views for illustrating a method of forming movable members and flow path side walls on the element substrate.
Figure 8B:
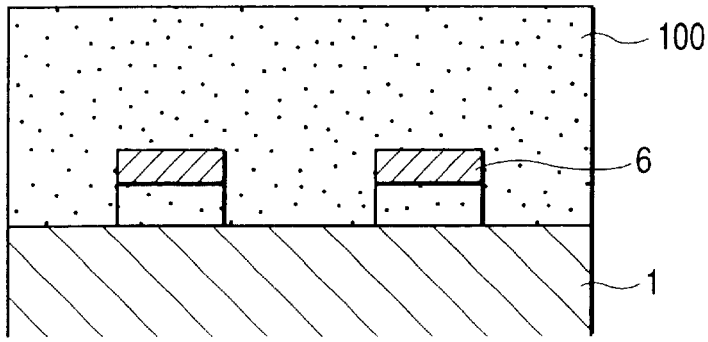

Next, photosensitive epoxy resin 100 of a negative type comprising a material shown in Table 1 below is applied to a thickness of 50 $\mu$m onto the element substrate 1 (see FIGS. 8A and 9A) on which the movable member 6 is formed as described above, by spin coating (see FIGS. 8B and 9B).

TABLE 1

| | |
|---|---|
| Material | SU-8-50 (produced by Michrochemical Corp.) |
| Applied thickness | 50 $\mu$m |
| Pre-bake | 90° C., 5 min., hot plate |
| Exposing apparatus | MPA600 (mirror projection aligner produced by Canon) |
| Amount of exposure light | 2 [J/cm$^2$] |
| PEB | 90° C., 5 min., hot plate |
| Developing liquid | propylene glycol 1-monomethyl ether acetate (Kishida Kagaku) |
| Main bake | 200° C., 1 hour |

Thereby, the photosensitive resin 100 can be provided between the movable member and the element substrate as well as on the surface of the movable member and therefore, it becomes possible to manufacture a liquid discharge head having a highly reliable movable member of which the deformation by resin is suppressed.

The material of the wall member used in the present invention will now be described. As the material of the wall member, photosensitive resin is preferable because the liquid flow paths can be formed easily and accurately by photolithography. High mechanical strength as a structural material, the close contact property with the substrate 1, an ink resisting property and a high resolving property for patterning the minute pattern of the liquid flow paths with a high aspect are required of such photosensitive resin. As the result of our earnest study, we have found that the cationic polymerization hardened substance of epoxy resin has excellent strength, close contact property and ink resisting property as the structural material and if the epoxy resin is solid at the ordinary temperature, it has an excellent patterning characteristic.

First, the cationic polymerization hardened substance of epoxy resin has high cross-linking density (high Tg) as compared with the ordinary hardened substance by acid anhydride or amine and therefore, exhibits an excellent characteristic as the structural material.

Also, by using epoxy resin solid at the ordinary temperature, the diffusion of a polymerization starting species produced from a cationic polymerization starting agent by the application of light into the epoxy resin is suppressed, and excellent patterning accuracy and shape can be obtained.

When a cantilever-like valve member like the movable member 6 is provided on the surface, an attempt to apply resin of high viscosity by spin coating may flex or bend the valve member when the resin is diffused. However, the above-mentioned material used as the photosensitive epoxy resin of the negative type in the present embodiment is relatively low in viscosity and therefore, there is not the possibility of the valve member being flexed or bent when such resin is applied by spin coating and further, the resin can also be flowed into the gap between the element substrate 1 and the movable member 6. We have also found that in order to prevent the deformation of the movable member and smooth the surface to which photo-curing resin is applied, a material having a sufficiently large amount of solid component and easy to level (flatten), specifically a material containing a solid component of 50% or more, is preferable as the photo-curing resin material as described above. We have further found that to make the application by spin coating possible, it is preferable that the molecular weight of resin be small, and specifically the average molecular weight of resin be 10,000 or less.

Figure 10A:
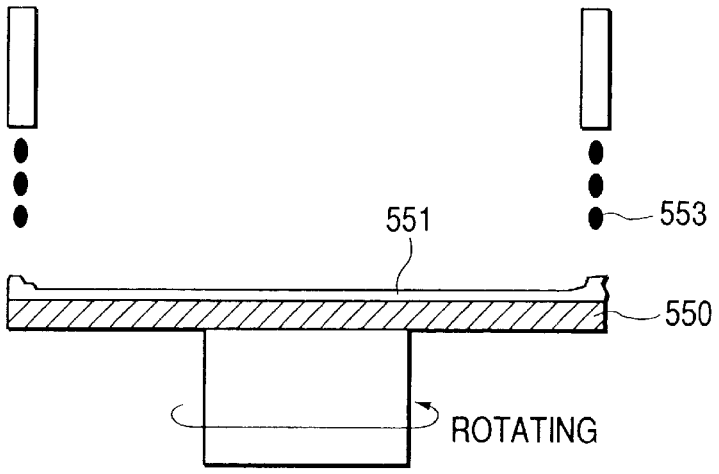
FIGS. 10A and 10B are views for illustrating the side rinse step at the step of forming the flow path side walls.
Figure 10B:
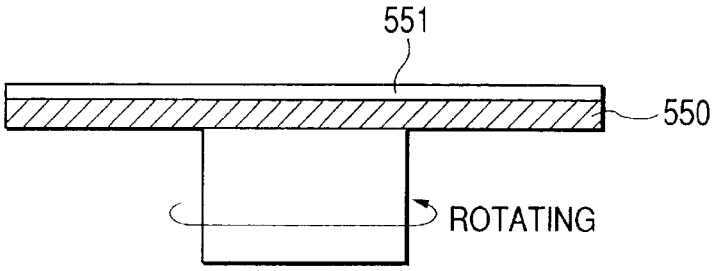

At this spin coating step, an excess resin coat material cannot fly well from the relation with the air resistance of the outer peripheral portion thereof and therefore, the peripheral portion of a wafer tends to swell. This poses a greater problem in accuracy as the film thickness of the coat becomes greater. So, in the present embodiment, as shown in FIGS. 10A and 10B, mixed liquids 553 of acetone and IPA (isopropyl alcohol) resolving the resin coat material were dripped to the peripheral portion of a wafer 550 (the side rinse step), whereby the uniformity of the thickness of resin coat film 551 on the wafer could be improved.

Figure 8C:
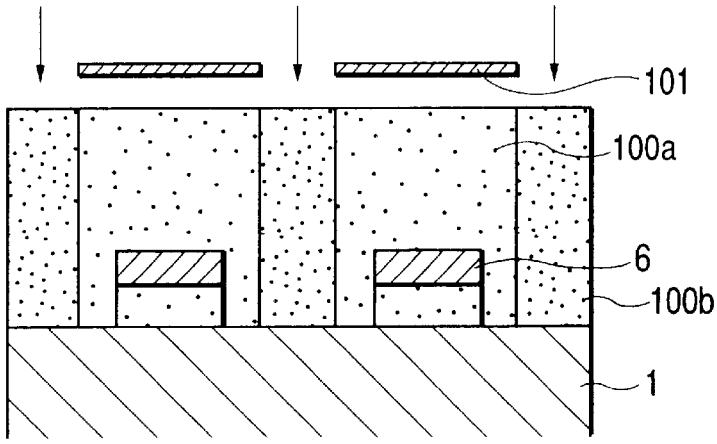

Subsequently, as shown in Table 1 above, the pre-baking of the epoxy resin 100 was effected under the conditions of 90° C. and 5 minutes by the use of a hot plate, whereafter by the use of an exposing apparatus (MPA 600), the epoxy resin 100 is exposed into a predetermined pattern with an amount of exposure light of 2[J/cm$^2$] (see FIG. 8C).

Figure 11:
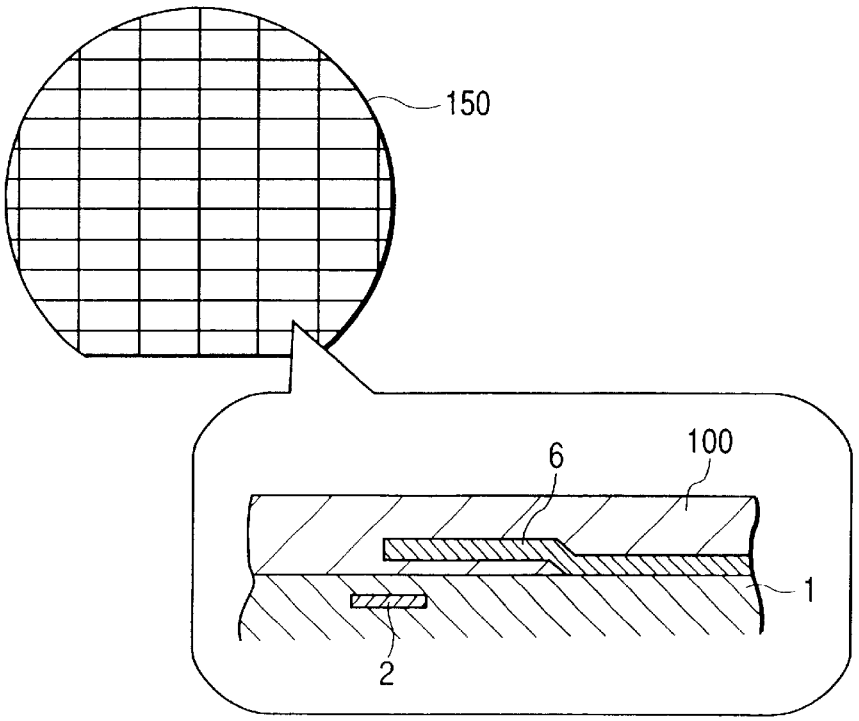
FIG. 11 shows the state after the spin coat step and the side rinse step have been effected at the step of forming the flow path side walls.
Figure 12:
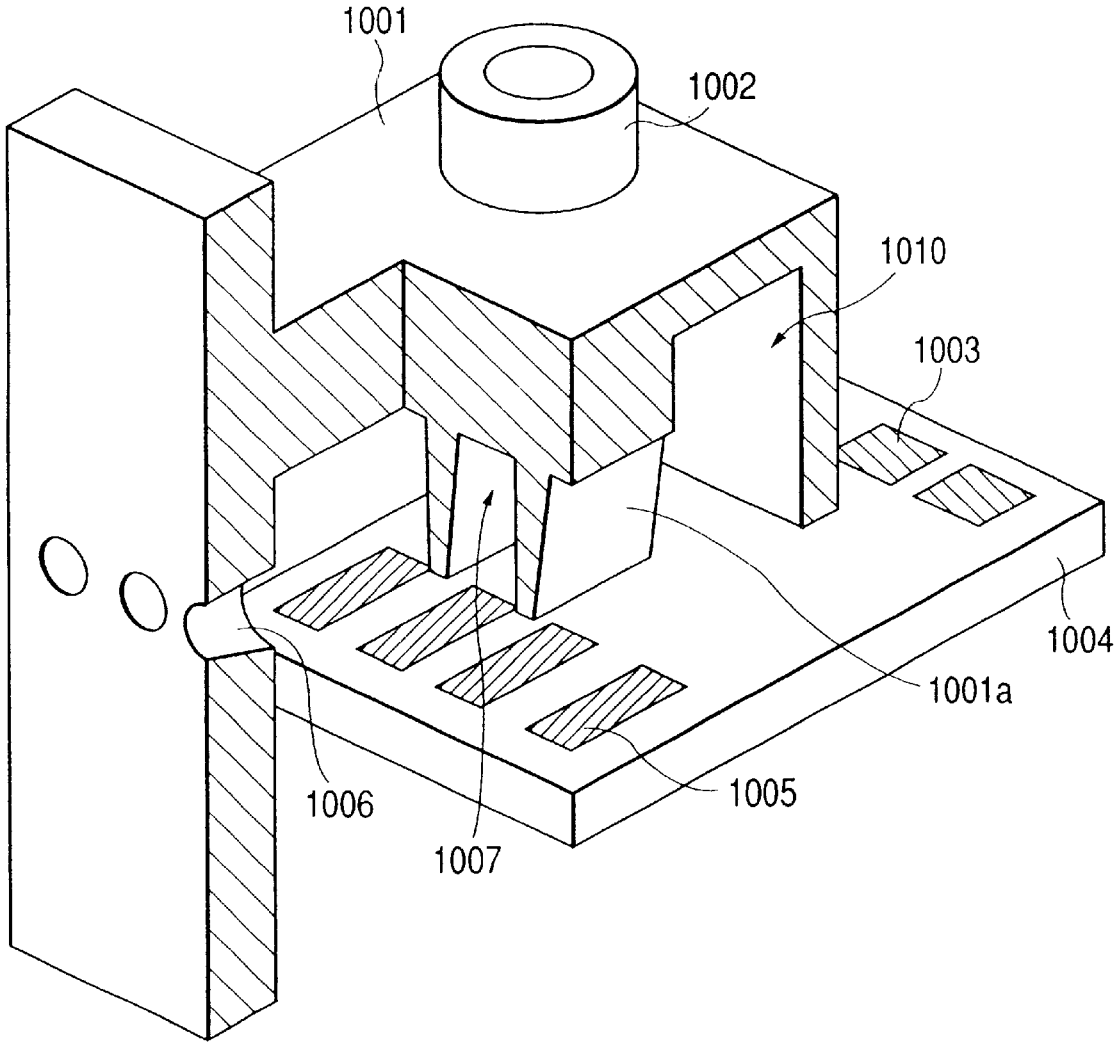
FIG. 12 PRIOR ART
FIG. 12 is a partly broken away perspective view showing a liquid discharge head according to the prior art.
Figure 13:
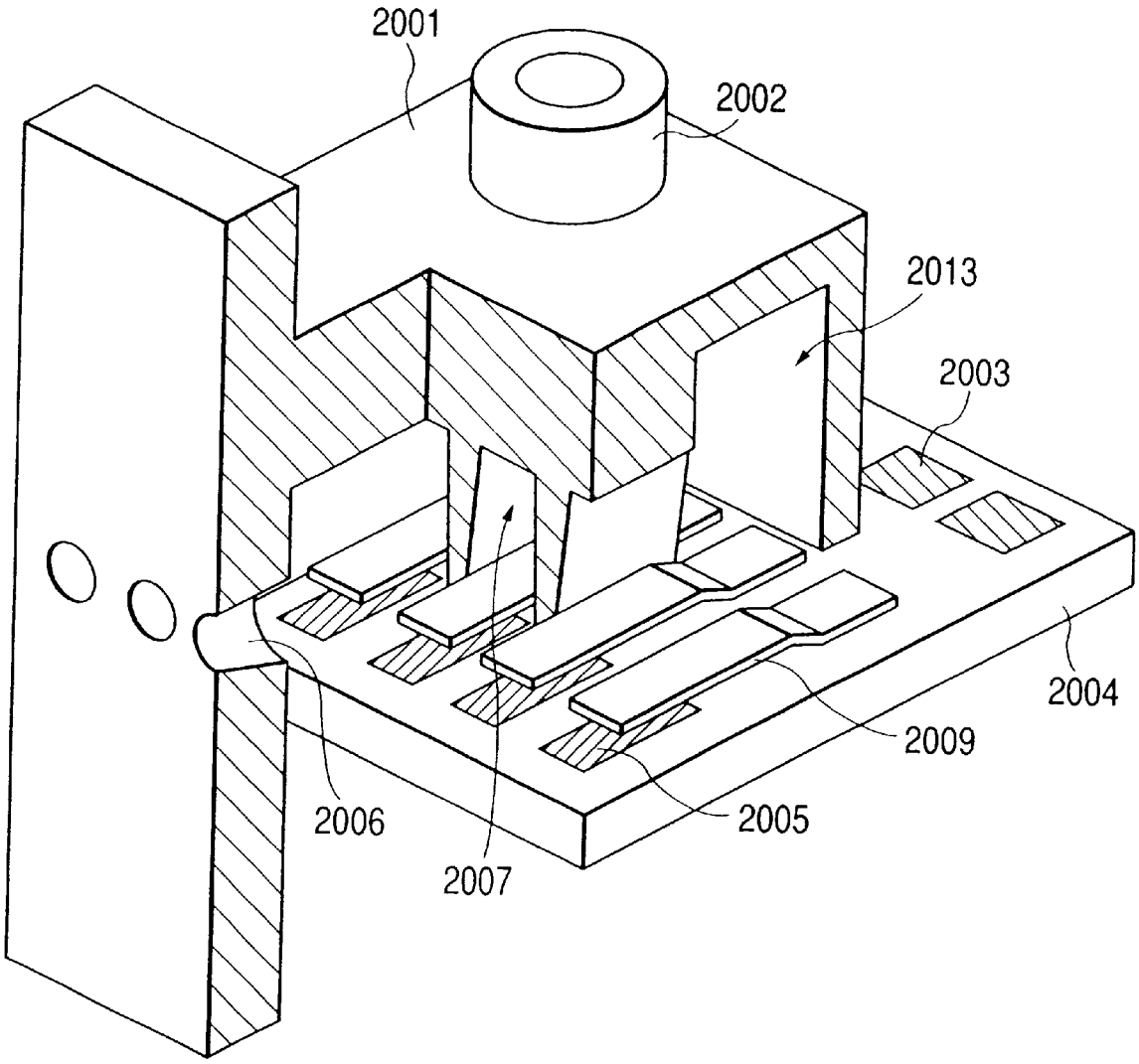
FIG. 13 PRIOR ART
FIG. 13 is a partly broken away perspective view showing another example of the liquid discharge head according to the prior art.
Figure 14A:
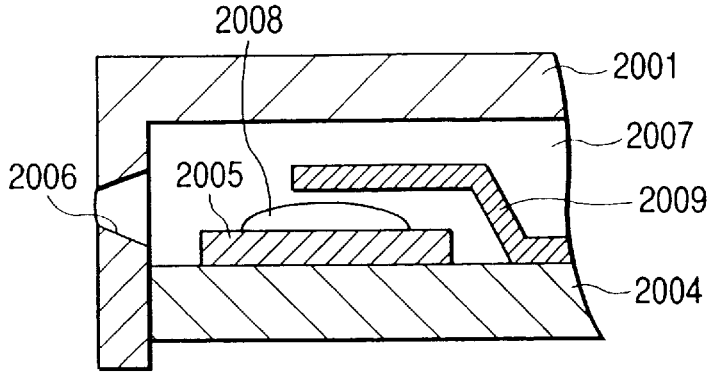
FIG. 14A PRIOR ART
FIGS. 14A, 14B, 14C and 14D are cross-sectional views along the direction of a flow path for illustrating the liquid discharging method by the liquid discharge head shown in FIG. 13.
Figure 14B:
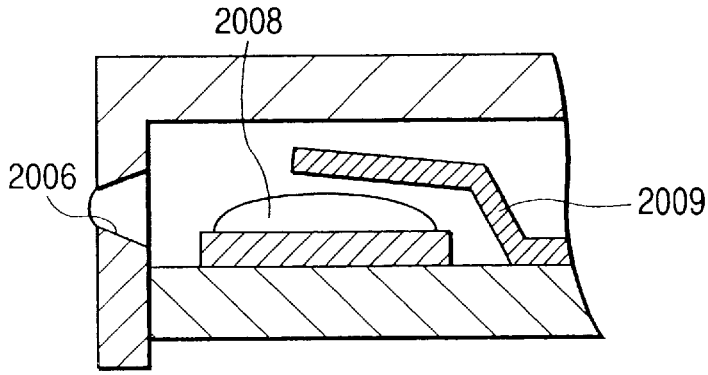
FIG. 14B PRIOR ART
Figure 14C:
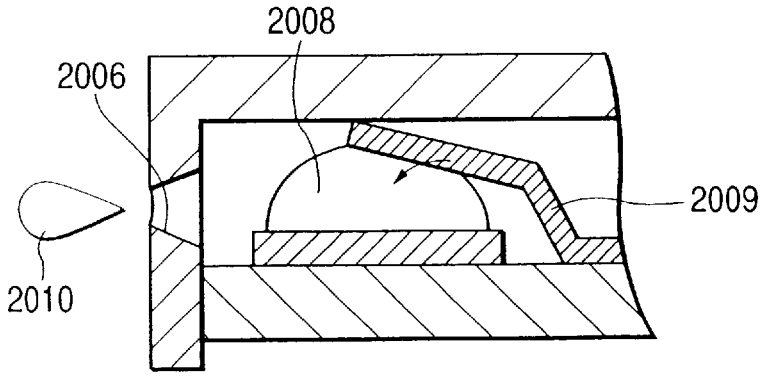
FIG. 14C PRIOR ART
Figure 14D:
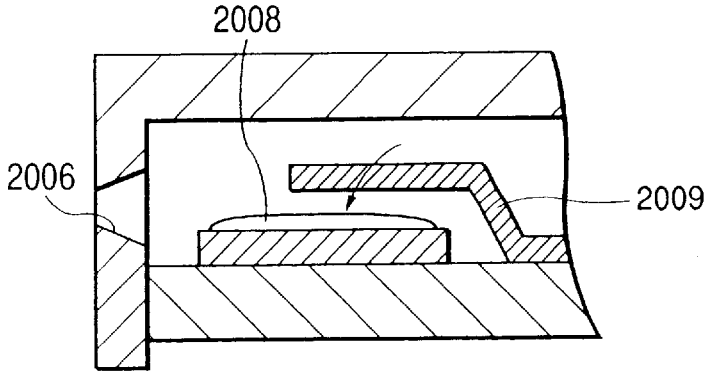
FIG. 14D PRIOR ART
Figure 15:
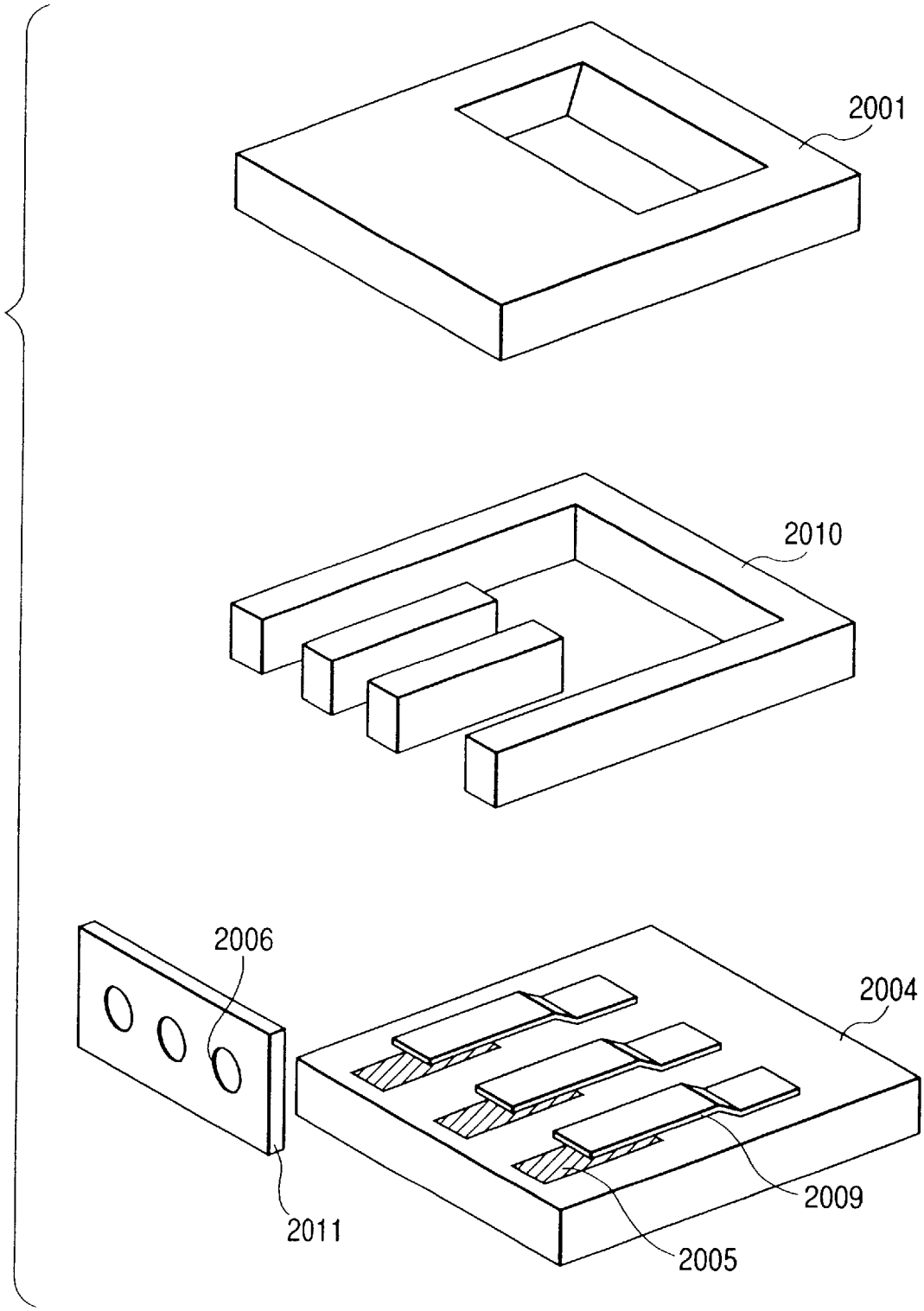
FIG. 15 PRIOR ART
FIG. 15 is a perspective view for illustrating a method of manufacturing the prior-art liquid discharge head shown in FIG. 13.

The photo-curing resin which is photosensitive resin of the negative type has its exposed portion hardened and the unexposed portion thereof is not hardened. Therefore, at the above-described exposing step, only a portion to form the flow path side walls 9 is exposed by a mask 101 and the other portions are not exposed. The resin which has flowed into the area between the movable member 6 and the element substrate 1 is not hardened because the exposure light is intercepted by the mask 101. Also, by carrying out the resin coating step (the applying step) and the side rinse step at a time as described above, the wall member can be formed flatly after the movable member 6 has formed a gap forming portion between it and the element substrate 1 (see FIG. 11). Further, the resin of the negative type which has flowed into between the movable member 6 and the element substrate 1 is not hardened and can therefore be simply removed. In FIG. 11, the reference numeral 150 designates the wafer.

Again, by the use of the hot plate, PEB of the epoxy resin 100 is effected under the conditions of 90° C. and 5 minutes, and etching is effected by the use of the above-mentioned developing liquid, whereafter the main baking is effected under the conditions of 200° C. and 1 hour. At the step of effecting the levelling of the resin after photo-cured (the main baking step), it is effective for improving the accuracy of the levelling to effect the baking at a temperature equal to or higher than the fusing point of resin (90° C. in the above-described resin) as described above and effect levelling flow.

Figure 8D:
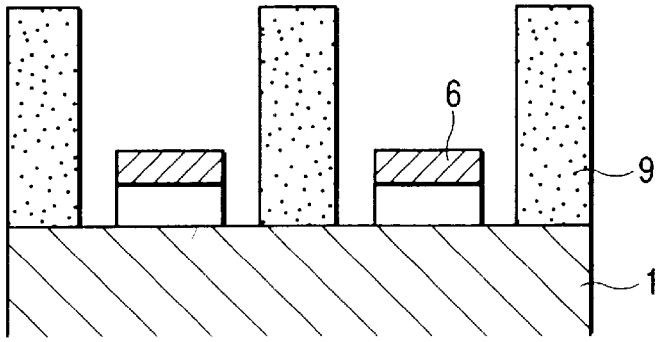
Figure 9A:
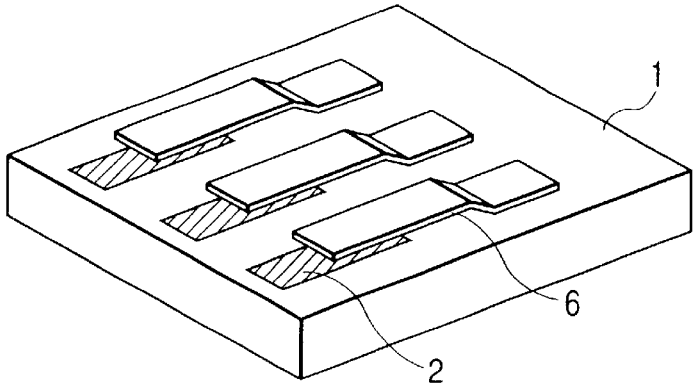
FIGS. 9A, 9B and 9C are perspective views for illustrating the method of forming the movable members and the flow path side walls on the element substrate.
Figure 9B:
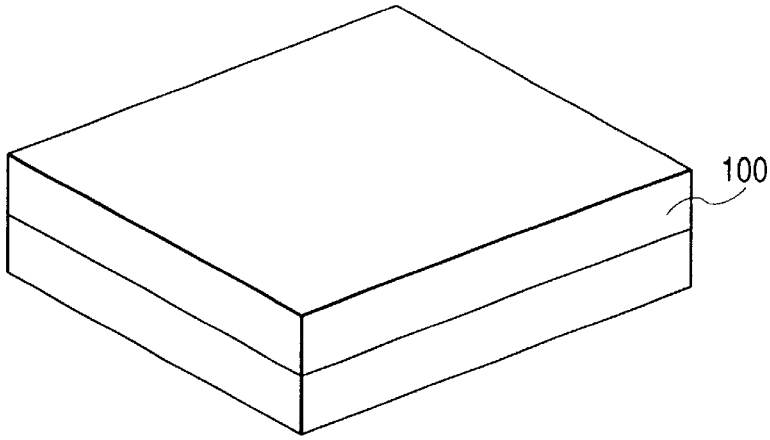
Figure 9C:
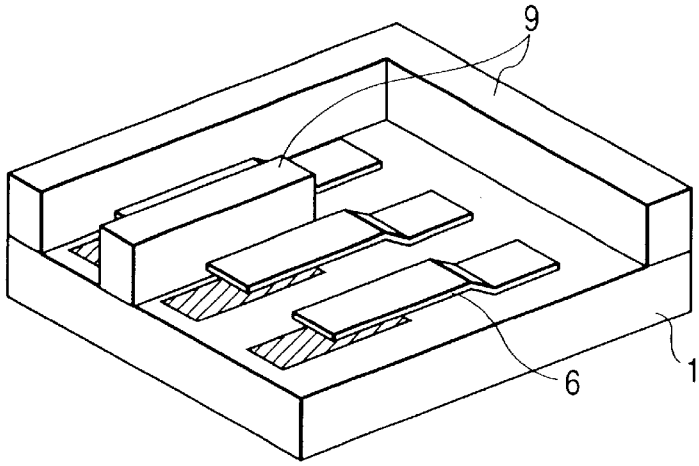

By the above-described steps, there is formed the element substrate 1 on the surface of which the movable member 6 and the flow path side walls 9 are provided as shown in FIGS. 8D and 9C.

Thereafter, the element substrate 1 is cut into a predetermined shape by dicing, and the top plate 3 and the orifice plate 4 are joined to the element substrate 1 by an adhesive. By effecting the main baking under the conditions as described above, the height accuracy of the flow path side walls 9 can be ±0.5 $\mu$m or less and therefore, the thickness of the adhesive layer applied to the upper surfaces of the flow path side walls 9 can be made small when the top plate 3 is joined.

In the liquid discharge head of the present invention made as described above, the wall member provided on the substrate is formed of photosensitive resin of the negative type hardened when exposed to light and therefore, as compared with a case where an inorganic material such as SiN or SiO is formed into film to thereby form a wall member, the manufacturing time can be shortened, and unlike the conventional wet process, thick film of several tens of $\mu$m can be formed.

Also, at a temperature equal to or higher than the fusing point of hardened resin, the baking of the resin is effected, whereby the levelling flow of the upper surface of the wall member is effected highly accurately and therefore, it is not necessary to flatten the upper surface of the wall member by polishing or the like at a post-step, and the manufacturing steps are simplified and further, the manufacturing cost can be reduced.

While in the foregoing, description has been made of an example in which the present invention is applied to a liquid discharge head, the present invention can be applied not only to the liquid discharge head as described above, but generally to a minute mechanical apparatus having, for example, a first substrate on the surface of which a wall member constituting a liquid flow path, a movable member supported by and fixed to the first substrate with one end portion thereof as a free end with a gap between it and the first substrate in the liquid flow path on the first substrate, and a second substrate joined to the upper surface of the wall member.

What is claimed is:

1. A method of manufacturing a liquid discharge head having:

a discharge opening for discharging liquid droplets therefrom;

a wall member constituting a liquid flow path communicating with said discharge opening to supply liquid to said discharge opening;

a substrate provided with a bubble creating element for creating a bubble in said liquid; and a movable member supported by and fixed to said substrate with said discharge opening side thereof as a free end and provided at a position facing said bubble creating element in said liquid flow path with a gap between said movable member and said substrate;

the free end of said movable member being displaced away from said substrate by pressure produced by creating said bubble to thereby direct said pressure to said discharge opening side and discharge the droplet of said liquid from said discharge opening;

characterized by the steps of:

preparing the substrate provided with said movable member;

filling the gap between the movable member and said substrate with a liquid photo-curing resin, and applying said resin to said substrate by spin coating until said resin covers said movable member;

exposing that area of said photo-curing resin which excludes an area of an unexposed portion, of at least said liquid flow path, to light to thereby harden a portion corresponding to said wall member; and removing the unexposed portion of said photo-curing resin to thereby form said movable member in said liquid flow path.

2. A method of manufacturing a liquid discharge head according to claim 1, further having a step of baking of said resin at a temperature equal to or higher than a melting point of said hardened photo-curing resin after the step of removing the unexposed portion of said photo-curing resin.

3. A method of manufacturing a liquid discharge head according to claim 1, wherein the substrate having said movable member is cut in a state in which said wall member is provided thereon.

4. A method of manufacturing a liquid discharge head according to claim 1, wherein the substrate having said movable member is cut in a state in which a top plate is joined onto said wall member.

5. A method of manufacturing a liquid discharge head according to claim 4, wherein said substrate and said top plate are formed of a silicon material.

6. A method of manufacturing a liquid discharge head according to claim 1, wherein the substrate having said movable member is cut in a state in which said liquid flow path portion is filled with resin capable of being eluted.

7. A method of manufacturing a liquid discharge head according to claim 1, wherein said photo-curing resin is applied in a state in which epoxy resin solid at an ordinary temperature is melted in a solvent.

8. A method of manufacturing a liquid discharge head according to claim 7, wherein said photo-curing resin contains a solid component of 50% or more, and an average molecular weight thereof is 10,000 or less.

9. A method of manufacturing a liquid discharge head according to claim 1, wherein said wall member is a cationic polymerization hardened substance of epoxy resin.

* * * * *

UNITED STATES PATENT AND TRADEMARK OFFICE

CERTIFICATE OF CORRECTION

PATENT NO. : 6,591,500 B1
DATED : July 15, 2003
INVENTOR(S) : Suzuki et al.

It is certified that error appears in the above-identified patent and that said Letters Patent is hereby corrected as shown below:

Column 10,
Line 11, "A" should be deleted.

Signed and Sealed this

Ninth Day of December, 2003

JAMES E. ROGAN
*Director of the United States Patent and Trademark Office*